SKI BINDINGS

BACKGROUND OF THE INVENTION

This invention relates to the improvements of ski bindings and more particularly to the improvements of a front metal fitting.

In most cases, a wire type or center belt type ski binding comprises a toe piece unit for securely holding the toe of the ski boot, a heel piece unit for securely holding the heel of the ski boot, and a front metal fitting acting to apply a forward pressure to the heel piece unit. In such construction, the toe piece unit is generally provided with a safety mechanism which is constructed to operate a releasing mechanism when an excessive twisting force is applied to the foot of the skier. However, such mechanism is not yet satisfactory in that it is not sufficiently safe against the load acting in the longitudinal direction of the ski. Such binding is not suitable particularly for school children under ski training.

SUMMARY OF THE INVENTION

Accordingly, it is an object of this invention to provide an improved ski binding which is incorporated with a safety mechanism for protecting the skier from danger caused by an excessive longitudinal force.

Another object of this invention is to provide a ski binding having an improved front metal fitting which is compact and simple in construction and yet is capable of positively protecting the skier against dangerous forces.

According to this invention, these and other objects can be accomplished by providing a ski binding including a front metal fitting which comprises a base plate secured to a ski, a block and a spring seat mounted on the base plate to be slidable in the longitudinal direction of the ski, a compression spring interposed between the block and the spring seat, a lever pivotally mounted on the base plate, a link interconnecting the spring seat and the lever so as to bias the lever to rotate, means for applying a rearward force to the block from a heel piece, and a locking mechanism interposed between the block and the lever for releasing the lever when the block is moved rearwardly by the heel piece beyond a predetermined limit.

DESCRIPTION OF THE PREFERRED EMBODIMENT

Figure 1:
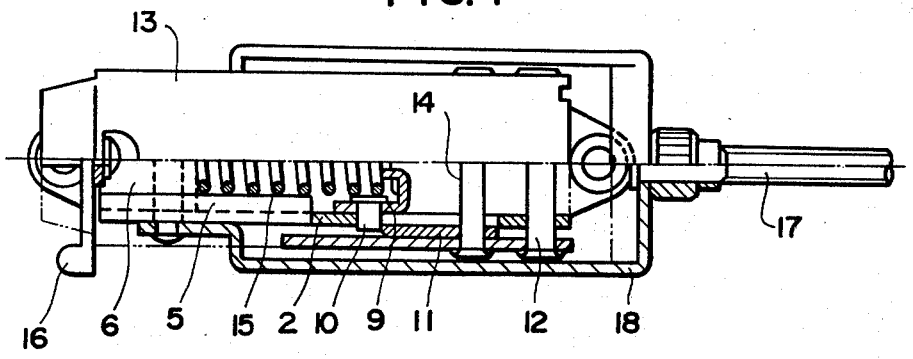
FIG. 1 is a plan view, partly in longitudinal section, of the front metal fitting of the ski binding embodying the invention.

A preferred embodiment of the front metal fitting illustrated in the accompanying drawings comprises a base plate 1 which is secured to the ski by screws, not shown, two side walls 2 and 2' of the base plate 1, each provided with two elongated slots 3 and 4 extending in the longitudinal direction of the ski, a transverse pin 5 received in the slots 3 at the fore ends thereof (left hand end as viewed in FIGS. 1 and 2) and a block 6 secured to the transverse pin 5. The block 6 is provided with a longitudinal threaded opening 7 to receive an adjusting screw 8 comprising an adjusting mechanism.

Figure 2:
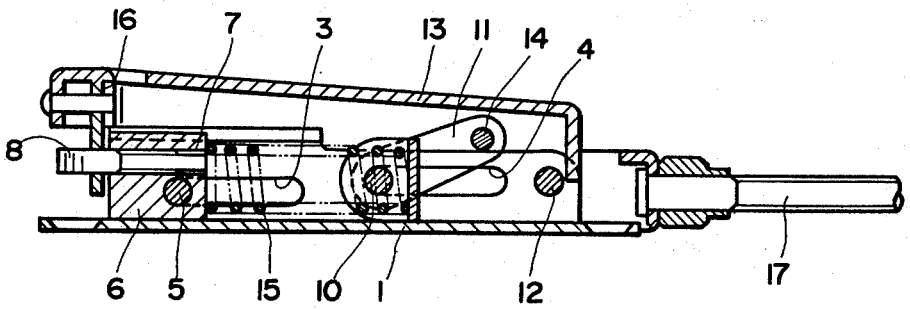
FIG. 2 shows a longitudinal section of the front metal fitting shown in FIG. 1.

Bosses 10 are slidably received in the slots 4 and the opposite ends of the bosses are connected to the spring seat 9. The opposite ends of the bosses are connected to one ends of links 11. A lever 13 is pivotally mounted on the base plate 1 near one end thereof by means of a transverse pin 12 and a transverse pin 14 is provided to the left and slightly above the pin 12, as shown in FIG. 2. The upper ends of the levers 11 are secured to the pin 14. A compression spring 15 is interposed between block 6 and spring seat 9. Accordingly, due to the force of the compression spring, the lever 13 is normally biased to rotate in the clockwise direction about 12, as viewed in FIG. 2. A stop member 16 is rotatably mounted on the fore end of the lever 13 and a hook 16' provided for the stop member 16 normally engages the adjusting screw 8 thereby preventing the rotation of the lever 13 caused by the force of the compression spring.

A U-shaped yoke 18 is secured to one end of a center belt or side wire, not shown, through a length adjusting mechanism 17, the opposite end of the center belt or side wire being connected to a heel piece unit, not shown. The left hand end of the U-shaped yoke 18 is connected to the opposite ends of the pin 5.

In the binding described above, so long as the hook 16' of the stop member 16 engages the projecting end of the adjusting screw 8, the rotation of lever 13 is positively prevented. Accordingly, the spring seat 9 is held stationary so that the block 6 is maintained at a position at which the force of spring 15 acting to the left and the force applied to the block from the heel of the boot through the heel piece unit, the center belt or side wire, not shown, the length adjusting mechanism 17, the U-shaped yoke 18 and the transverse pin 5 balance each other. However, when an excessive force exceeding a safety limit is applied to the ski boot in the direction toward rear or right as viewed in FIG. 2, the block 6 is displaced to the right by compressing the compression spring 15. This displacement of the block 6 also displaces the adjusting screw 8 screwed to the block 6. When the free end of the screw 8 disengages the hook 16' of the stop member 16, the locking mechanism is released whereby the lever 13 is rotated about pin 12 in the clockwise direction by the force of spring 15 which is transmitted to the lever 13 through links 11 and transverse pin 14. As a result, the spring 15 elongates to remove the force applied to the heel of the ski boot in the rearward direction whereby the heel of the ski boot is freed. This releasing force can be varied by changing the length of the portion of the adjusting screw received in the threaded block 6. Accordingly, it is advantageous to apply suitable color symbols on the head of the adjusting screw so that the skier may readily determine the length of the portion of the screw 8 threaded into the block 6.

To apply the binding of this invention after release, the ski boot heel is caused to abut the toe piece unit and the heel piece unit and then the stop member 16 is operated to cause its hook 16' to engage the adjusting screw 8.

As described hereinabove, the novel binding of this invention is particularly useful in a case wherein an abnormal load is applied to the skier's foot when he falls forwardly. In this case, the locking mechanism is

SKI BINDINGS

BACKGROUND OF THE INVENTION

This invention relates to the improvements of ski bindings and more particularly to the improvements of a front metal fitting.

In most cases, a wire type or center belt type ski binding comprises a toe piece unit for securely holding the toe of the ski boot, a heel piece unit for securely holding the heel of the ski boot, and a front metal fitting acting to apply a forward pressure to the heel piece unit. In such construction, the toe piece unit is generally provided with a safety mechanism which is constructed to operate a releasing mechanism when an excessive twisting force is applied to the foot of the skier. However, such mechanism is not yet satisfactory in that it is not sufficiently safe against the load acting in the longitudinal direction of the ski. Such binding is not suitable particularly for school children under ski training.

SUMMARY OF THE INVENTION

Accordingly, it is an object of this invention to provide an improved ski binding which is incorporated with a safety mechanism for protecting the skier from danger caused by an excessive longitudinal force.

Another object of this invention is to provide a ski binding having an improved front metal fitting which is compact and simple in construction and yet is capable of positively protecting the skier against dangerous forces.

According to this invention, these and other objects can be accomplished by providing a ski binding including a front metal fitting which comprises a base plate secured to a ski, a block and a spring seat mounted on the base plate to be slidable in the longitudinal direction of the ski, a compression spring interposed between the block and the spring seat, a lever pivotally mounted on the base plate, a link interconnecting the spring seat and the lever so as to bias the lever to rotate, means for applying a rearward force to the block from a heel piece, and a locking mechanism interposed between the block and the lever for releasing the lever when the block is moved rearwardly by the heel piece beyond a predetermined limit.

BRIEF DESCRIPTION OF THE DRAWINGS

Figure 3:
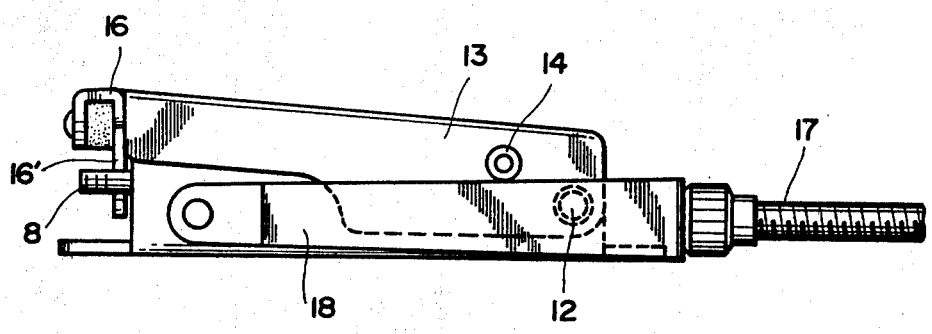
FIG. 3 is a side view of the front metal fitting.

In the accompanying drawings:

FIG. 1 is a plan view, partly in longitudinal section, of the front metal fitting of the ski binding embodying the invention;

FIG. 2 shows a longitudinal section of the front metal fitting shown in FIG. 1;

FIG. 3 is a side view of the front metal fitting and

Figure 4:
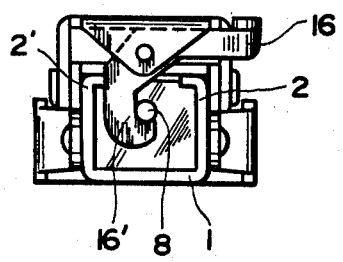
FIG. 4 is a left hand end view of the front metal fitting.

FIG. 4 is a left hand end view of the front metal fitting.

DESCRIPTION OF THE PREFERRED EMBODIMENT

A preferred embodiment of the front metal fitting illustrated in the accompanying drawings comprises a base plate 1 which is secured to the ski by screws, not shown, two side walls 2 and 2′ of the base plate 1, each provided with two elongated slots 3 and 4 extending in the longitudinal direction of the ski, a transverse pin 5 received in the slots 3 at the fore ends thereof (left hand end as viewed in FIGS. 1 and 2) and a block 6 secured to the transverse pin 5. The block 6 is provided with a longitudinal threaded opening 7 to receive an adjusting screw 8 comprising an adjusting mechanism.

Bosses 10 are slidably received in the slots 4 and the opposite ends of the bosses are connected to the spring seat 9. The opposite ends of the bosses are connected to one ends of links 11. A lever 13 is pivotally mounted on the base plate 1 near one end thereof by means of a transverse pin 12 and a transverse pin 14 is provided to the left and slightly above the pin 12, as shown in FIG. 2. The upper ends of the levers 11 are secured to the pin 14. A compression spring 15 is interposed between block 6 and spring seat 9. Accordingly, due to the force of the compression spring, the lever 13 is normally biased to rotate in the clockwise direction about 12, as viewed in FIG. 2. A stop member 16 is rotatably mounted on the fore end of the lever 13 and a hook 16′ provided for the stop member 16 normally engages the adjusting screw 8 thereby preventing the rotation of the lever 13 caused by the force of the compression spring.

A U-shaped yoke 18 is secured to one end of a center belt or side wire, not shown, through a length adjusting mechanism 17, the opposite end of the center belt or side wire being connected to a heel piece unit, not shown. The left hand end of the U-shaped yoke 18 is connected to the opposite ends of the pin 5.

In the binding described above, so long as the hook 16′ of the stop member 16 engages the projecting end of the adjusting screw 8, the rotation of lever 13 is positively prevented. Accordingly, the spring seat 9 is held stationary so that the block 6 is maintained at a position at which the force of spring 15 acting to the left and the force applied to the block from the heel of the boot through the heel piece unit, the center belt or side wire, not shown, the length adjusting mechanism 17, the U-shaped yoke 18 and the transverse pin 5 balance each other. However, when an excessive force exceeding a safety limit is applied to the ski boot in the direction toward rear or right as viewed in FIG. 2, the block 6 is displaced to the right by compressing the compression spring 15. This displacement of the block 6 also displaces the adjusting screw 8 screwed to the block 6. When the free end of the screw 8 disengages the hook 16′ of the stop member 16, the locking mechanism is released whereby the lever 13 is rotated about pin 12 in the clockwise direction by the force of spring 15 which is transmitted to the lever 13 through links 11 and transverse pin 14. As a result, the spring 15 elongates to remove the force applied to the heel of the ski boot in the rearward direction whereby the heel of the ski boot is freed. This releasing force can be varied by changing the length of the portion of the adjusting screw received in the threaded block 6. Accordingly, it is advantageous to apply suitable color symbols on the head of the adjusting screw so that the skier may readily determine the length of the portion of the screw 8 threaded into the block 6.

To apply the binding of this invention after release, the ski boot heel is caused to abut the toe piece unit and the heel piece unit and then the stop member 16 is operated to cause its hook 16′ to engage the adjusting screw 8.

As described hereinabove, the novel binding of this invention is particularly useful in a case wherein an abnormal load is applied to the skier's foot when he falls forwardly. In this case, the locking mechanism is released automatically thereby protecting the skier from injury.

If the binding is used in combination with a rotary releasing type toe piece unit it will contribute greatly to decreasing injuries which tend to occur during ski training of school children.

While the invention has been described in terms of a preferred embodiment thereof many changes and modifications will be obvious to one skilled in the art without departing from the scope of the invention as defined in the appended claims.

What is claimed is:

1. A ski binding including a front metal fitting which comprises a base plate secured to a ski, a block and a spring seat each mounted on said base plate to be slidable in the longitudinal direction of said ski, a compression spring interposed between said block and said spring seat, a lever pivotally mounted on said base plate, a link interconnecting said spring seat and said lever so as to bias said lever to rotate, means for applying a rearward compressive force to said block from a heel piece, and a locking mechanism interposed between said block and said lever for releasing said lever when the block is moved rearwardly, relative to said lever, by the heel piece beyond a predetermined limit.

2. The ski binding according to claim 1 wherein said locking mechanism comprises a stop member provided with a hook and rotatably mounted on the free end of said lever, and an adjusting screw adjustably threaded in said block and normally engaged by said hook so that when the free end of said adjusting screw disengages said hook, the lever is released to rotate under the force of said compression spring.

3. The ski binding according to claim 1 wherein said means for applying a rearward force to said block comprises a transverse pin extending through said block and elongated slots provided on opposite side walls of said base plate, a U-shaped yoke member having one end connected to the opposite ends of said transverse pin and a length adjusting member connected between the opposite end of said U-shaped yoke member and said heel piece.

4. The ski binding according to claim 1 wherein one end of said link is connected to a boss which is connected to said spring seat and slidably received in another elongated slot provided for the side wall of said base plate.

* * * * *